United States Patent [19]

Nomura et al.

[11] Patent Number: 4,470,689

[45] Date of Patent: Sep. 11, 1984

[54] IMAGE FORMING APPARATUS AND PROCESS UNIT

[75] Inventors: Akihiro Nomura; Shigeyoshi Onoda, both of Kawasaki; Fumio Nishino, Tokyo; Shinji Kanemitsu, Ichikawa; Morikazu Mizutani, Kawasaki; Hiroshi Nitanda, Tokyo, all of Japan

[73] Assignee: Canon Kabushiki Kaisha, Tokyo, Japan

[21] Appl. No.: 381,685

[22] Filed: May 25, 1982

[30] Foreign Application Priority Data

Jun. 2, 1981 [JP] Japan ..... 56-85424
Apr. 16, 1982 [JP] Japan ..... 57-64151

[51] Int. Cl.[3] ..... G03G 15/00

[52] U.S. Cl. ..... 355/3 R; 355/3 DR; 355/14 R; 355/71

[58] Field of Search ..... 355/3 R, 14 R, 71, 67, 355/3 DD, 3 DR, 3 SH; 430/120; 118/620

[56] References Cited

U.S. PATENT DOCUMENTS 3,883,242 5/1975 Takahashi et al. ..... 355/3 R
3,966,316 6/1976 Pfeifer et al. ..... 355/3 DR
3,985,436 10/1976 Tanaka et al. ..... 355/3 DD X
4,114,998 9/1978 Shimizu et al. ..... 355/3 DR
4,166,692 2/1979 Okada et al. ..... 355/3 R X
4,254,202 3/1981 Matsumoto et al. ..... 430/120
4,335,950 6/1982 Gunzelmann et al. ..... 355/3 SH X
4,357,095 11/1982 Sugawa et al. ..... 355/3 R
4,376,577 3/1983 Okamoto ..... 355/3 R X
4,376,579 3/1983 Wakao ..... 355/3 DR

*Primary Examiner*—A. C. Prescott
*Attorney, Agent, or Firm*—Fitzpatrick, Cella, Harper & Scinto

[57] ABSTRACT

This specification discloses a process kit removably mountable on the main body of an image formation apparatus and integrally having an image bearing member and a part or the whole of process device acting on the image bearing member, and an image formation apparatus using such kit. The image formation apparatus having an image bearing member, process device acting on the image bearing member, a process kit removably mountable on the main body of the apparatus and integrally having the image bearing member and the process device, and a cover movable to a first position for covering the surface of the image bearing member provided in the process kit and a second position retracted away from the first position. This specification also discloses a process kit removably mountable on the main body of the image formation apparatus and having an image bearing member, a cover movable to a first position for covering the surface of the image bearing member and a second position retracted away from the first position, and process device acting on the image bearing member.

42 Claims, 20 Drawing Figures

IMAGE FORMING APPARATUS AND PROCESS UNIT

BACKGROUND OF THE INVENTION

1. Field of the Invention

This invention relates to a process unit removably mountable on the main body of an image formation apparatus and integrally having an image bearing member and a part or the whole of process means for acting on the image bearing member, and to an image formation apparatus using such kit.

2. Description of the Prior Art

Description will hereinafter be made with an electrophotographic copying apparatus taken as an example of the image formation apparatus.

An electrophotographic copying apparatus has required interchange of the photosensitive medium as the image bearing member, supply of developer, discard of waste toner, cleaning of corona wire, interchange or adjustment of various expendable parts, etc. to be effected periodically, and these have heretofore been carried out by expert service men. Accordingly, a service man must go to the user's office or the like each time his service is needed and this has been very cumbersome.

Therefore, recently, as shown in U.S. Pat. No. 3,985,466, it has been considered to construct a kit in which image formation means such as a photosensitive drum, a developing device, a cleaner, a charger, etc. are made into a unitary structure and to interchange the various units at a time during interchange of the photosensitive drum, thereby reducing the maintenance work. By adopting the above-described construction, the user can simply interchange each process unit, also referred to as a process kit, which particularly requires periodical maintenance, thus reducing the maintenance work to be done by the service man. Further, by interchanging the kit with a process kit which contains toner of other color, formation of colored images becomes possible. Alternatively, by interchanging the kit with a process kit which incorporates other developing means, the user can use developing means corresponding to the original image to be copied.

However, when the kit is interchanged or when the kit is removed from the apparatus body, the hand may touch the photosensitive drum held by the kit to stain or injure the drum. Possibly, the photosensitive drum having, for example, a zinc oxide photosensitive layer or an organic semiconductor photosensitive layer as the image bearing member held by the kit may be exposed to light with a result that the photosensitive layer is deteriorated. The injury or stain on the photosensitive drum or the deterioration of the photosensitive layer may adversely affect the formed images.

Particularly, where a process kit is used, the kit is often interchanged for the purpose of preservation or for the purpose of interchange with a process kit containing therein toner of another color as previously described, even during a period in which the kit is usable, and therefore it is necessary to positively protect the photosensitive drum.

SUMMARY OF THE INVENTION

It is an object of the present invention to provide a process kit which can prevent the surface of the image bearing member from being injured or stained, for example, during interchange of the process kit or during preservation of the kit removed from the main body, and an image formation apparatus using such kit.

It is another object of the present invention to provide a process kit which can prevent deterioration of the image bearing member, for example, during interchange of the process kit or during preservation of the kit removed from the main body, and an image formation apparatus using such kit.

It is still another object of the present invention to provide a process kit which protects the image bearing member to enable clear images to be obtained, and an image formation apparatus using such kit.

In one aspect, the present invention is characterized by an image bearing member, process means acting on the image bearing member, a process kit removably mountable on the main body of the apparatus and integrally having the imaging bearing member and the process means, and a cover movable to a first position for covering the surface of the image bearing member provided in the process kit and a second position retracted away from the first position.

In another aspect, the present invention is a process kit removably mountable on the main body of an image formation apparatus and having an image bearing member, a cover movable to a first position for covering the surface of the image bearing member and a second position retracted away from the first position, and process means acting on the image bearing member.

Thus, in the process kit of the present invention or the image formation apparatus using such kit, protection of the image bearing member can be reliably achieved to enable clear images to be obtained.

The invention will become more fully apparent from the following detailed description thereof taken in conjunction with the accompanying drawings.

DESCRIPTION OF THE PREFERRED EMBODIMENTS

The present invention will hereinafter be described in greater detail with respect to some embodiments thereof.

Description will first be made of an embodiment of a copying apparatus to which the present invention is applicable.

Figure 1:
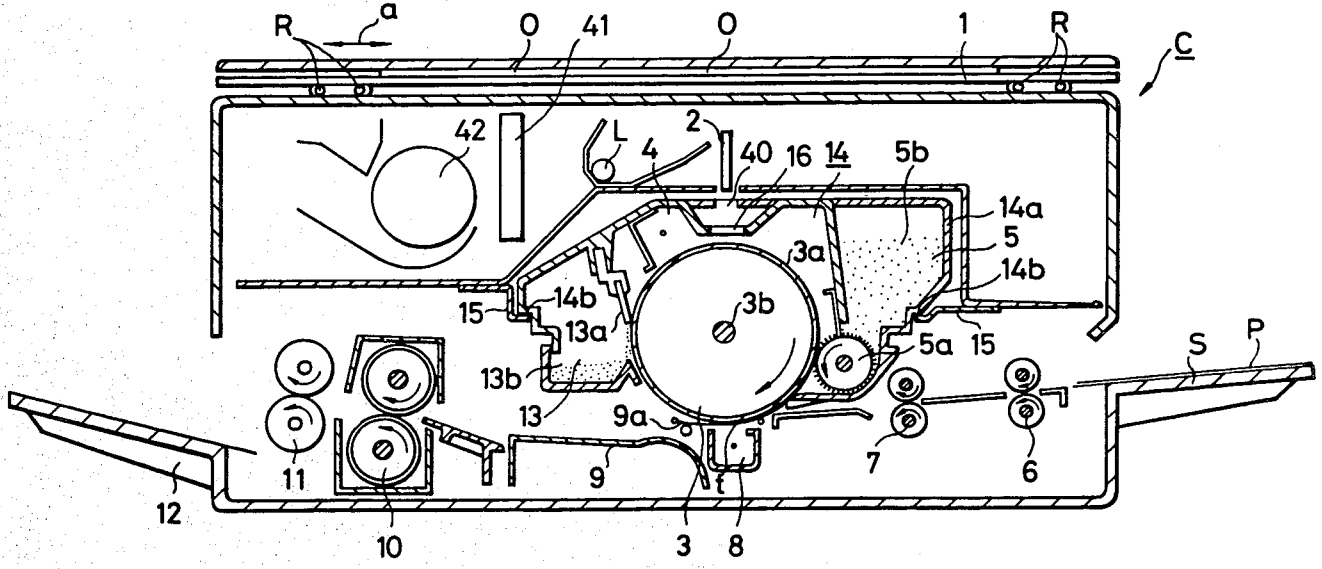
FIG. 1 is a cross-sectional view of a copying apparatus body to which the present invention is applicable.

FIG. 1 is a cross-sectional view of a copying apparatus body C. In FIG. 1, reference numeral 1 designates an original carriage formed of a transparent material such as glass and reciprocable on rails R in the direction of arrow a. Reference numeral 2 denotes a short-focus small-diameter imaging element array. An original O placed on the original carriage 1 is illuminated by an illuminating lamp L and the reflected optical image thereof is slit-exposed onto a photosensitive drum 3 by the array 2. The photosensitive drum 3 is rotatable about its axis 3*b* in the direction of the arrow. Designated by 4 is a charger for uniformly charging the photosensitive drum 3 covered with a zinc oxide photosensitive layer or an organic semiconductor photosensitive layer 3*a*. The drum 3 uniformly charged by the charger 4 is subjected to image exposure of the aforementioned reflected optical image by the element array 2, whereby an electrostatic latent image is formed on the drum. This electrostatic latent image is developed into a visible image by a developing device 5 comprising a magnet roller 5*a* and a toner reservoir 5*b*. On the other hand, a sheet P on a sheet supporting table S is fed onto the drum 3 by a feed roller 6 and register rollers 7 rotated in synchronism with the image on the photosensitive drum 3. By a transfer discharger 8, the toner image on the photosensitive drum 3 is transferred onto the sheet P. Thereafter, the sheet P is separated from the drum 3 by separator means 9*a* (for example, a separating belt or a separating corona discharger or the like) and directed to a fixing device 10 by a guide 9 for fixation of the toner image on the sheet P, whereafter the sheet P is discharged onto a tray 12 by discharge rollers 11. After the transfer of the toner image, any toner remaining on the drum 3 is removed therefrom by a cleaner 13. This cleaner 13 comprises a blade 13*a* and a toner reservoir 13*b*.

Figure 2:
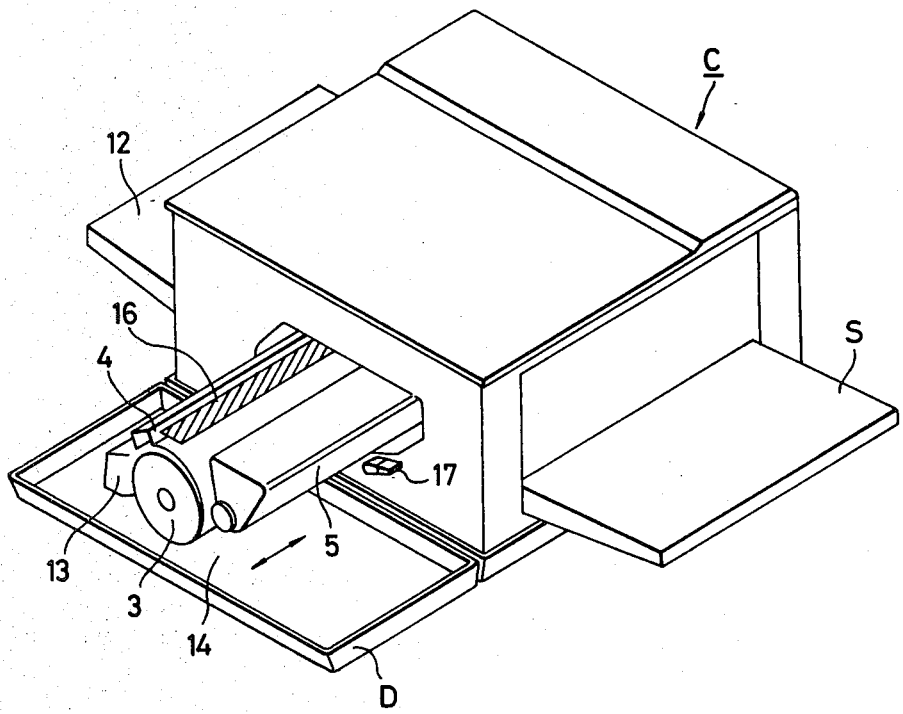
FIG. 2 is a perspective view thereof.
Figure 3:
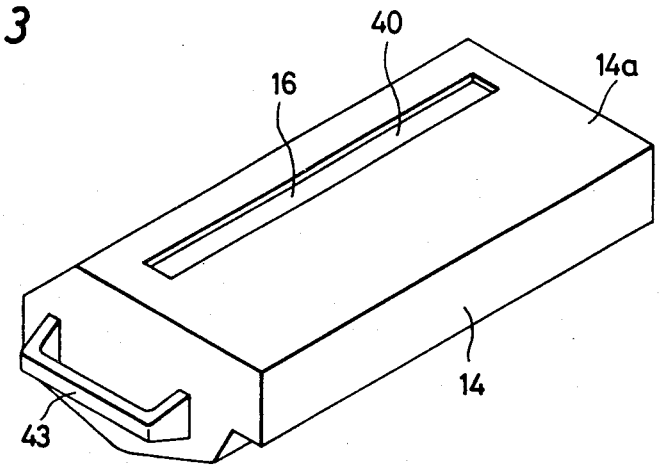
FIG. 3 is a perspective view of a process kit.

In the present embodiment, the photosensitive drum 3, and the charger 4, the developing device 5, the cleaner 13 and the filter F disposed around the photosensitive drum 3 are surrounded by a frame member 14*a* as a light-intercepting wall, and together constitute a process kit 14. The frame member 14*a* is formed of black rigid plastic, but alternatively it may be formed of metal or wood. As shown in FIG. 2, the process kit 14 is provided with respect to the main body C so that it is withdrawable or dismountable in the direction of the rotational axis of the drum 3, and when the process kit is mounted on the main body, the sliding portion 14*b* of the frame member 14*a* of the process kit 14 is engaged with the main body side guide 15 and guided thereby. In FIG. 2, the kit 14 is shown with the frame member 14*a* thereof removed to show individual units. FIG. 3 is a perspective view of the process kit having the frame member 14*a* attached thereto. Reference numeral 40 designates a window through which the image exposure light is applied onto the drum 3, and reference numeral 16 denotes a filter member. Designated by 17 is an anti-slippage lever for positioning the kit 14 at its inserted position when the kit 14 is inserted into the main body C. D denotes the front door of the main body C which is openable and closable with respect to the main body C and in FIG. 2, it is opened with its lower portion as the hinge. Reference numeral 41 designates a heat absorbing filter, reference numeral 42 denotes a fan, and reference numeral 43 designates the handle of the kit 14.

Description will now be made of a moving mechanism for a cover protecting the surface of the photosensitive drum 3 held by the kit 14 when the process kit 14 is removed from the main body C of the copying apparatus.

In the embodiment which will now be described, an example is shown in which the cover is formed of a non-transparent rigid material so as to intercept the light to the surface of the photosensitive drum 3 provided in the kit 14 and to prevent the surface of the drum 3 from being injured.

Figure 4:
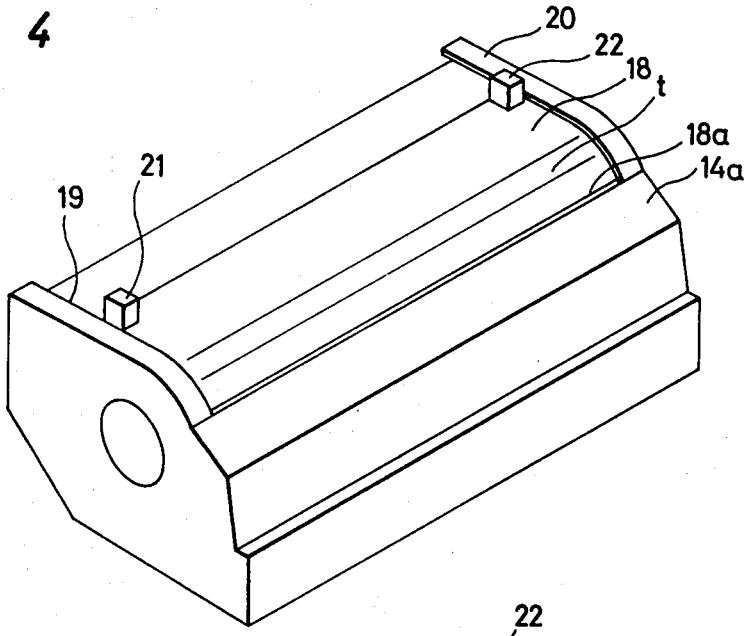
FIG. 4 is a perspective view of the process kit with a cover attached thereto.
Figure 5:
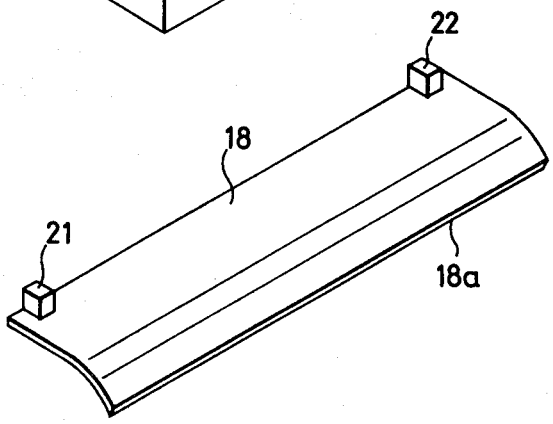
FIG. 5 is a perspective view of the cover.

In the present embodiment, the kit 14 has a transfer area opening t provided in the portion thereof which becomes opposed to the transfer charger 8 when the kit has been inserted into the main body C. On the frame member 14*a* of the kit 14, rails 19 and 20 are provided at the opposite end portions of the opening t (FIG. 4). A cover 18 for intercepting light is slidably fitted on the rails 19 and 20 and opens and closes the opening t. The cover 18 is partly arcuate as shown in FIG. 5 and is smoothly slidable along the rails 19 and 20. As shown in FIG. 4, the end 18*a* of the cover 18 bears against one end of the frame member 14*a* with the opening t being closed, and the cover holds such position unless any extraneous force is applied thereto. Since the cover 18 is formed of a rigid member such as a non-transparent black plastic plate or a metal plate (an iron plate or the like), it can intercept light so that the light may not impinge on the surface of the photosensitive drum and can also prevent the surface of the photosensitive drum from being injured, by closing the opening t and covering the photosensitive drum 3 as shown in FIG. 4. The zinc oxide photosensitive layer or the organic semiconductor photosensitive layer 3*a* used in the present embodiment is liable to be deteriorated particularly for the wavelength of 300–400 [nm] or 400 [nm] or less, but the black plastic plate or the iron plate can reliably intercept the light of this wavelength range.

Dowels 21 and 22 are provided on the opposite ends of the cover 46.

Figure 6:
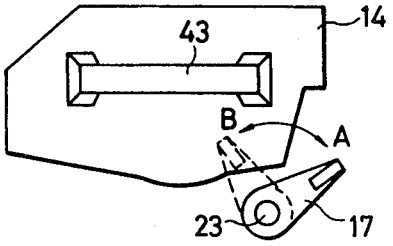
FIG. 6 is a front view illustrating the operation of the anti-slippage lever of the process kit.
Figure 7:
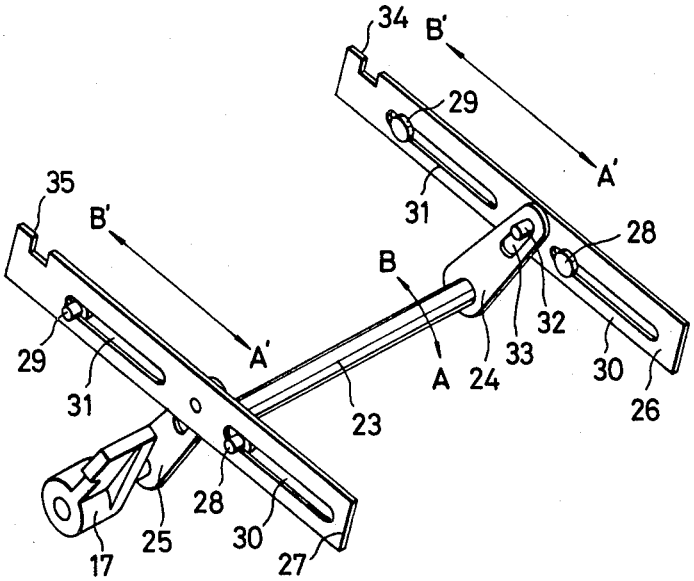
FIG. 7 is a perspective view of a driving device for the cover.

On the other hand, the anti-slippage lever 17 provided on a side plate (not shown) of the main body C is pivotable about a shaft 23 between positions A and B as shown in FIG. 6 and, when the lever 17 is in the position A, the process kit 14 can be drawn out of the main body C, but when the lever 17 is in the position B, the process kit 14 cannot be drawn out of the main body C due to the interference of the lever 17. Further, as shown in FIG. 7, arms 24 and 25 are secured to the shaft 23 of the lever 17 and are also pivotable about the shaft 23 between the positions A and B in synchronism with the lever 17. Pins 28 and 29 are secured to the back side plate (not shown) of the main body C, and a slide plate 26 is mounted for sliding along slots 30 and 31 engaged by the pins 28 and 29. The slide plate 26 has a pin 32 projected therefrom which is fitted in the slot 33 of the arm 24. In response to the pivotal movement of the lever 17 from the position A to the position B, the slide plate 26 slides from a position A' toward a position B'. A slide plate 27 mounted on the front side plate (not shown) of the main body is similar in construction to the slide plate 26 and, if the lever 17 is moved from the position A to the position B, the slide plate 27 also slides from the position A' toward the position B' in response thereto.

Figure 8:
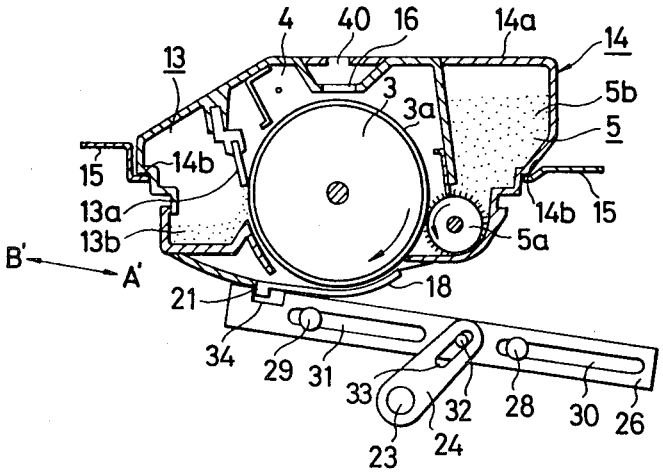
FIG. 8 is a front view showing the cover in its closed position.
Figure 9:
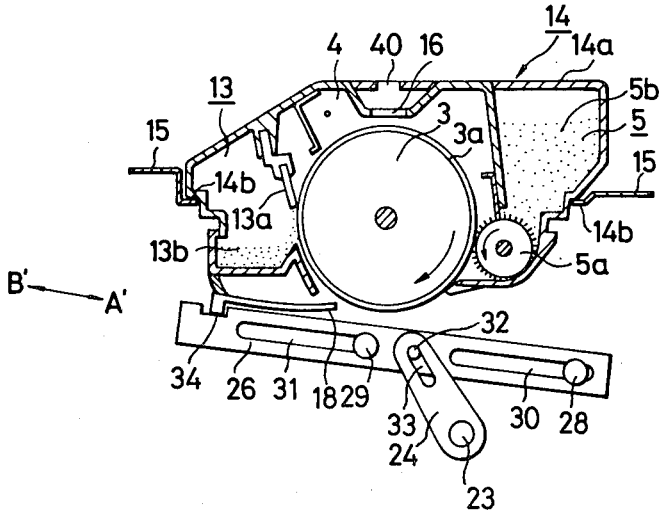
FIG. 9 is a front view showing the cover in its opened position.

Now, the slide plates 26 and 27 are provided with cut-aways 34 and 35 which are adapted to fit on the aforementioned dowels 21 and 22 of the cover 18 when the process kit 14 inserted along the guide 15 of the main body C has arrived at a predetermined inserted position. This condition is shown in FIG. 8. FIG. 8 is a cross-sectional view showing the process kit 14 as it has been inserted into or drawn out of the main body C, and at this time, the lever 17 is in the position A and the cut-away 34 of the slide plate 26 is fitted on the dowel 21 with the cover 18 being in a position wherein it closes the transfer opening t and covers the photosensitive drum 3 so that light may not impinge on the drum 3. When the lever 17 is moved to the position B to position the process kit 14 with respect to the main body C after the kit 14 has been inserted into the main body C, the slide plates 26 and 27 slide toward the position B' and in response thereto, the cover 18 also slides toward the position B' to uncover the opening t and expose the photosensitive drum, thus bringing about a condition in which copying is possible (FIG. 9). The spacing between the slide plates 26 and 27 and the spacing between the dowels 21 and 22 are greater than the width of the copy paper and therefore, these do not interfere with the passage of copy paper.

Next, when the process kit 14 is to be drawn out of the main body C, the lever 17 is moved to the position A to permit movement of the kit 14, whereupon the cover 18 closes the opening t (FIG. 8) and the surface of the photosensitive drum is covered by the cover 18, so that even after the kit 14 has been taken out of the main body C, the cover prevents light from impinging on the photosensitive drum 3 and deteriorating the same, and thus the cover protects the drum 3. That is, the cover 18 can be moved in response to the release of the positioning of the process kit 14.

In the above-described embodiment, the cover 18 may be provided with a click so as to maintain the open and closed positions. Alternatively, the cover may always be biased to its open or closed position by a spring or the like.

Thus, in the present embodiment, when the kit is inserted into or removed from the main body, the cover moves in response to movement of the lever, whereby the photosensitive drum can reliably be shielded from light or prevented from being injured.

The mechanism for driving the cover 18 may also be effected by utilization of a plunger.

According to the present embodiment, as described above, when the kit 14 is taken out of the main body C, the exposed portion of the photosensitive drum 3 (namely, that portion which corresponds to the transfer opening t provided in the frame member 14*a* for the image transfer) can be covered by the cover 18. Thus, the kit 14 can be taken out of the main body C with the photosensitive drum 3 being shielded from light, that is, without its photosensitive layer being deteriorated or injured, and the kit 14 can be kept away from the main body C.

In the present embodiment, the surface of the drum 3 is protected not only during the mounting or dismounting of the kit 14 with respect to the main body C, but also, for example, when the front door or the like is opened for the repair of the main body C, the cover may be moved by operating this lever to thereby protect the photosensitive drum.

Also, in the case of the present embodiment, the cover is moved in response to movement of the lever, but it is also possible to move the cover 18 manually in the condition shown in FIG. 4. In this example, the cover 18 can be directly manually closed along the rails 19 and 20 to thereby permit jam treatment to be carried out. After completion of the jam treatment, the cover 18 may be manually opened.

An example will be shown below in which the cover is driven in response to the movement of the kit during the insertion or the removal thereof with respect to the main body.

Figure 10:
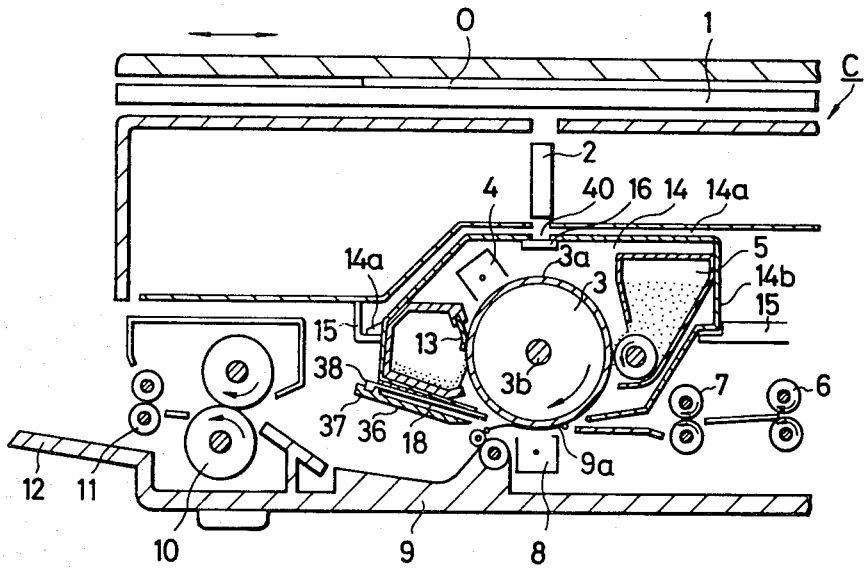
FIG. 10 is a cross-sectional view of a copying apparatus to which another embodiment of the present invention is applied.

FIG. 10 shows a condition in which the process kit 14 has been inserted into the copying apparatus body C with the cover 18 opened.

Figure 11:
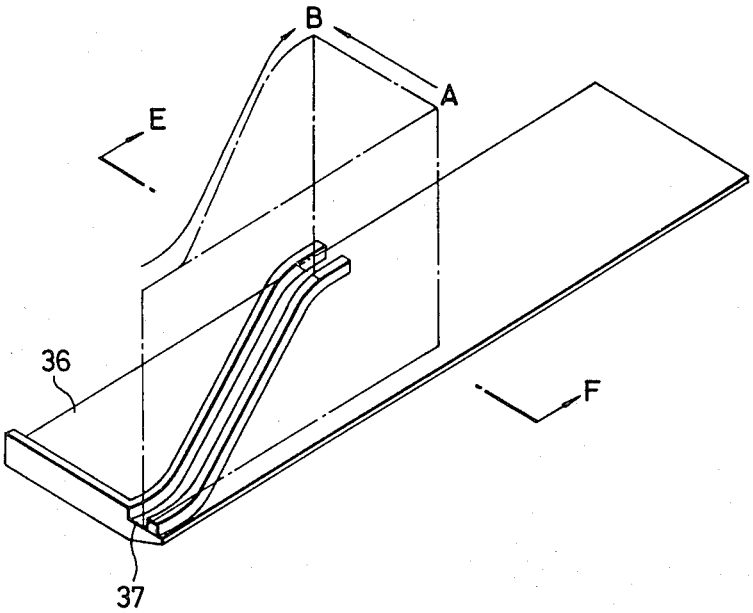
FIG. 11 is a perspective view of a portion of a stay.
Figure 12:
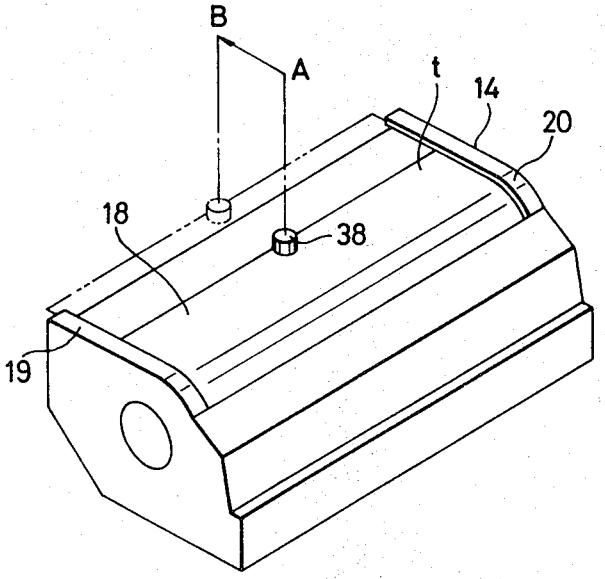
FIG. 12 is a perspective view of a kit.

In the main body C, a stay 36 is provided at a position opposed to the cover 18 of the kit 14 inserted. As shown in FIG. 11, an S-shaped slot 37 is provided in the stay 36. Also as shown in FIG. 12, a pin 38 is provided on the cover 18 of the process kit 14 substantially centrally of the insertion direction thereof and at the opening-closing direction side edge, and the cover 18 may be opened by the pin 38 being moved from A to B. When the process kit 14 is half-inserted into the main body C, the pin 38 meshes with the slot 37 at a position A' indicated in FIG. 11 and, when the kit 14 is further inserted, the pin 38 is guided by the slot 37 and the kit 14 arrives at a predetermined inserted position and the pin 38 finally comes to a position B. This, as viewed from the process kit 14, means that the pin 38 has moved from A to B and therefore, the cover 18 changes from its closed position to its opened position. Conversely, when the process kit 14 is drawn out of the main body C, the cover 18 likewise changes from its opened position to its closed position. FIG. 10 is a cross-sectional view obtained by sectioning FIG. 11 along line EF. Thus, in the present embodiment, the cover 18 can be opened or closed in response to the operation of inserting the process kit 14 into the copying apparatus body C or the operation of taking the kit 14 out of the main body C.

Thus, according to the present embodiment, whenever the process kit has been drawn out of the main body, the photosensitive drum is shielded from light by the cover and so, the photosensitive drum is never deteriorated. If the cover is formed of a shock-resisting material, the photosensitive drum will become free of the danger that the user touches the photosensitive drum or strikes it against something to thereby injure the drum.

Figure 13:
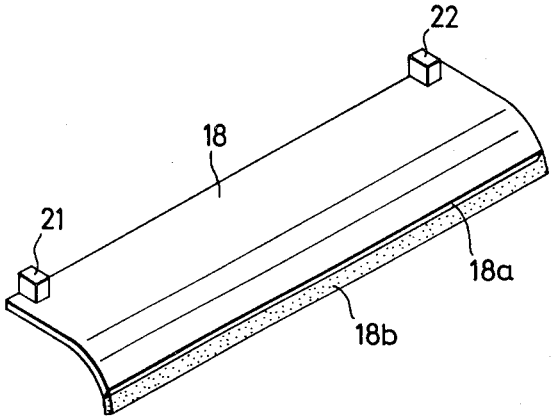
FIG. 13 is a perspective view of another embodiment of the cover.

FIG. 13 shows still another embodiment.

In the present embodiment, sponge-like moltplene 18*b* is attached to the fore end 18*a* of the cover 18. Thus, the gap between the fore end 18*a* of the cover 18 and the end of the frame member 14*a* is completely closed by this moltplene 18*b* to thereby enhance the light-intercepting effect.

Figure 14:
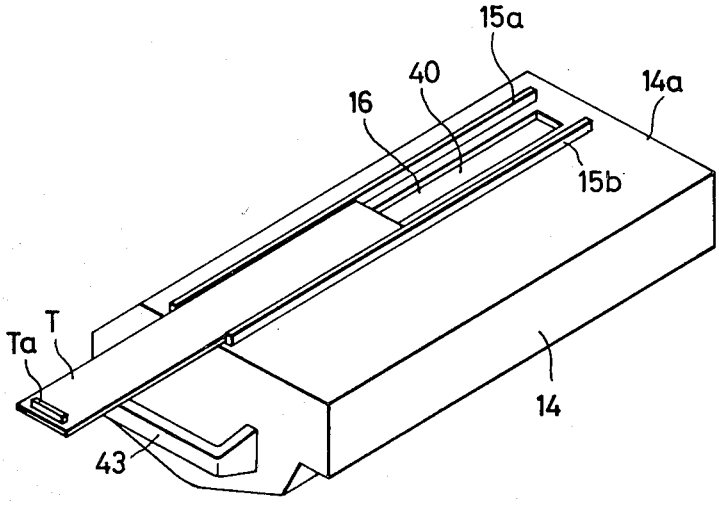
FIG. 14 is a perspective view showing an embodiment of the cover of the slit exposure portion.

FIG. 14 shows still another embodiment.

In the present embodiment, a slit opening 40 through which the image exposure light is applied onto the drum 3 is closed.

In FIG. 14, reference numerals 40*a* and 40*b* designate rails secured along the slit opening 40 through which the image exposure light is applied onto the drum 3. If a slide plate T formed of a material similar to that of the cover is fitted along the rails 40*a* and 40*b* by means of a knob Ta, the slit opening 40 can be closed. If the slide plate T is drawn out of the rails 40*a* and 40*b*, the opening 40 can be opened. Thus, the present embodiment can more reliably intercept the light to the image bearing member. The slide plate T need not always be employed, but for example, a pivotable plate may be mounted along the opening 40. The opening-closing of the opening 40 can also be easily accomplished by this means. Also, in the present embodiment, mounting or dismounting of the slide plate T with respect to the rails 40*a* and 40*b* may be effected with the kit 14 mounted to or removed from the main body C.

By being used in combination with the previous embodiment, the present embodiment can reliably intercept the light to the image bearing member, whereas when the width of the opening is short, it is not always necessary to open and close the opening for image exposure as in the present embodiment, but opening-closing of the opening may be effected as required. The present embodiment is of course applicable not only to the opening-closing of the opening 40 for image exposure, but also, for example, to the opening-closing of an opening for pre-exposure if such opening is provided.

Each of the above-described embodiments has been shown with respect to a case where the cover is formed of a black non-transparent rigid material so that light may not impinge on the surface of the photosensitive drum 3 and that the surface of the drum 3 may not be injured. However, the present invention is not restricted thereto, but the cover may be formed, for example, of a non-transparent soft material (black polyester film, moltplene or the like) primarily for the purpose of light-interception (including reflection and absorption of light) or formed of a transparent rigid material (transparent plastic or the like) primarily for the purpose of preventing the drum surface from being injured. Further, even in a case where light-interception is the purpose, the cover need not always be formed of a non-transparent material, but may be formed of a light-transmitting material if it can intercept light rays of a wavelength range which will deteriorate the photosensitive layer. Also, for example, in the case of an image formation method wherein a magnetic latent image is formed on an insulating layer, preventing the insulating layer from being injured will become a primary purpose of the cover.

The material of the cover may be a metal such as iron, aluminum or the like, or other known material such as resin, wood or the like. If, of these materials, a material having elasticity is employed, the opening-closing operation of the cover can be accomplished more smoothly. Further, if, of these materials, a shock-resisting material is selected, the kit can be mounted or dismounted with the photosensitive drum 3 being covered by the cover.

In the present embodiment, an image bearing member provided with an organic semiconductor photosensitive layer or a zinc oxide photosensitive layer has been shown as an example, whereas it will be apparent that the present invention is not restricted thereto, and other photosensitive layers are also usable. In the present invention, the image bearing member is not restricted to one using a photosensitive layer but it will be apparent that the invention is also applicable, for example, to an image bearing member using an insulating layer or the like. The shape of the image bearing member is not restricted to the drum shape, but may be, for example, an endless belt passed over pulleys.

The present invention is not restricted to the magnetic brush development, but other developing systems such as, for example, the cascade development, the fur brush development or the powder cloud development are also applicable.

The cleaning system is not restricted to the blade cleaning, but the fur brush cleaning, the roller cleaning, the web cleaning or the like is applicable.

Further, the imaging element is not restricted to the short-focus small-diameter imaging element array, but may also be an ordinary lens or a bar lens or the like.

The process for image formation is restricted in no way, but for example, the Carlson system, the NP system (U.S. Pat. No. 3,666,363) or the PIP system is also applicable.

Figure 15A:
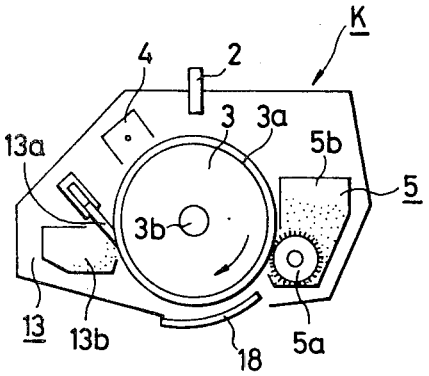
FIGS. 15A–15F are side views of further embodiments of the process kit.
Figure 15B:
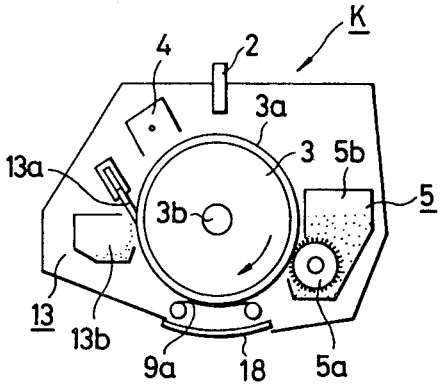
Figure 15C:
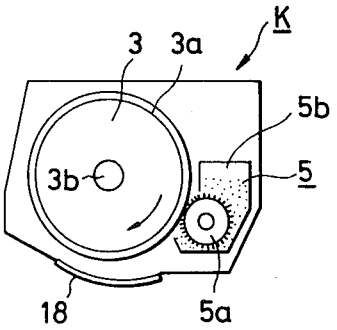
Figure 15D:
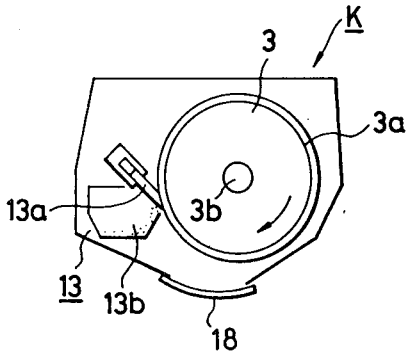
Figure 15E:
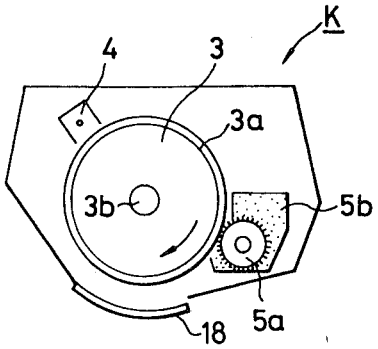
Figure 15F:
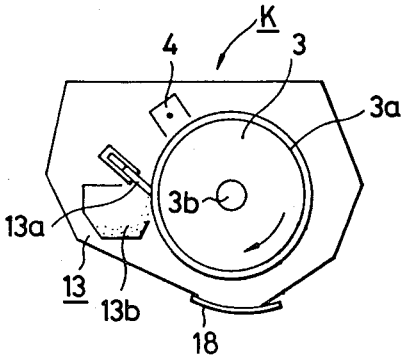

Also, in the present embodiment, an example in which, in addition to the photosensitive drum, various process means such as the developing device, the cleaner, the charger, etc. have been integrally incorporated in the process kit has been shown, but the present invention is not restricted thereto. For example, as shown in FIGS. 15A–15F, the array 2, the charger 4, the developing device 5 and the cleaner 13 as the process means, integrally with the photosensitive drum 3, may be incorporated in the kit K (FIG. 15A). Further, the separator means 9*a* may be integrally incorporated (FIG. 15B). Also, the developing device 5 and the photosensitive drum 3 (FIG. 15C), the cleaner 13 and the photosensitive drum 3 (FIG. 15D), the charger 4, the developing device 5 and the photosensitive drum 3 (FIG. 15E), or the charger 4, the cleaner 13 and the photosensitive drum 3 (FIG. 15F) may be integrally incorporated. The image bearing member is not restricted to the photosensitive drum 3, as already mentioned. That is, the process kit may integrally have the image bearing member and a part or the whole of the process means. The process means acting on the image bearing member are, in the present embodiment, the array 2, the charger 4, the developing device 5, the transfer discharger 8, the separator means 9*a*, the cleaner 13, etc.

According to the present invention, as has been described above, there can be provided a process kit in which the image bearing member is protected by a cover which prevents deterioration or harm, and an image formation apparatus using such kit.

What we claim is:

1. An image forming apparatus for forming an image on an image receiving member, comprising:

a main assembly;

means forming a process unit, detachably mountable to said main assembly at a predetermined operating position thereof, for use in forming a said image on said receiving member, said process unit means including an image bearing member, processing means for acting on the image bearing member to form an image, a protection cover for protecting said image bearing member, and supporting means for supporting said cover for movement between a closed position wherein said protection cover covers said image bearing member and an open position wherein said protection cover is retracted from the closed position;

said main assembly including operative means for cooperating with said processing means to complete a said image on the image receiving material; and actuating means for moving said protection cover to the closed position in association with separation of said process unit from said operative position on the main assembly.

2. An apparatus according to claim 1, wherein said main assembly includes an upper part and a lower part, and said separation occurs between said process unit means and said lower part.

3. An apparatus according to claim 1, wherein said main assembly includes in upper part and a lower part, and said separation is caused by lowering the lower part of the process unit.

4. An apparatus according to claim 1, wherein said separation is caused by drawing the process unit means from the main assembly.

5. An apparatus according to claim 1, wherein said protection cover is biased by a spring provided in the process unit means.

6. An apparatus according to claim 1, wherein said protection cover is biased by a spring provided in the process unit means, said spring rotationally biasing said cooperative member of said process unit means.

7. An apparatus according to claim 1, wherein said cooperative member is engageable with an arm provided in the main assembly usable with the process unit means.

8. An apparatus according to claim 1, wherein said cooperative member is engageable with a slot provided in a lever provided in the main assembly usable with the process unit means.

9. An apparatus according to claim 1, wherein said supporting means includes swingable arms, 10. An apparatus according to claim 1, wherein the supporting means for said cover comprises rails.

11. An apparatus according to claim 1, further comprising a transfer corona discharger disposed adjacent said process unit means at said predetermined position.

12. An apparatus according to claim 1, further comprising image fixing means disposed adjacent said process unit means at said predetermined position.

13. An apparatus according to claim 1, further comprising roller means disposed adjacent said process unit means at said predetermined position for transporting the image receiving member.

14. An apparatus according to claim 1, further comprising dowels for moving when said process unit means is moved from said predetermined position.

15. An apparatus according to claim 1, further comprising a pin for moving when said process unit means is moved from said predetermined position.

16. An apparatus according to claim 1, wherein said protection cover protects said image bearing member from mechanical damage to said image bearing member.

17. An apparatus according to claim 1, wherein said protection cover protects said image bearing member from stain.

18. An apparatus according to claim 1, wherein said protection cover protects said image bearing member from receiving external light.

19. An image forming apparatus for forming an image on an image receiving member, comprising:

a main assembly;

means forming a process unit, detachably mountable to said main assembly at a predetermined operating position thereof, for use in forming a said image on said receiving member, said process unit means including an image bearing member, processing means for acting on the image bearing member to form an image, a protection cover for protecting said image bearing member, and supporting means for supporting said cover for movement between a closed position wherein said protection cover covers said image bearing member and an open position wherein said protection cover is retracted from the closed position;

said main assembly including operative means for cooperating with said processing means to complete a said image on the image receiving material; and means for releasably preventing said process unit from being separated from said predetermined operating position; and means interrelated with said preventing means and said protection cover to move said protection cover to the closed position upon release of the preventing action by said preventing means.

20. An apparatus according to claim 19, wherein said preventing means includes a lever.

21. An apparatus according to claim 19, further comprising a pair of actuating arms for moving when said process unit means is moved from said predetermined position.

22. An apparatus according to claim 19, wherein said supporting means includes swingable arms.

23. An apparatus according to claim 19, wherein said supporting means for said cover includes rails.

24. An apparatus according to claim 19, further comprising a transfer corona discharger disposed adjacent said process unit means at said predetermined position.

25. An apparatus according to claim 19, further comprising image fixing means disposed adjacent said process unit means at said predetermined position.

26. An apparatus according to claim 19, further comprising roller means disposed adjacent said process unit means at said predetermined position.

27. An apparatus according to claim 19, wherein said protection cover protects said image bearing member from mechanical damage to said image bearing member.

28. An apparatus according to claim 19, wherein said protection cover protects said image bearing member from stain.

29. An apparatus according to claim 19, wherein said protection cover protects said image bearing member from receiving external light.

30. A process unit detachably mountable to a main assembly of an image forming apparatus at a predetermined position thereof to enable image formation on an image receiving material, comprising:

an image bearing member;

processing means for acting on the image bearing member to form an image thereon in accordance with image information;

a protection cover for protecting the image bearing member;

supporting means for supporting said protection cover for movement between a closed position wherein said protection cover covers said image bearing member and an open position wherein said protection cover is retracted from the closed position; and actuating means for moving said protection cover to the closed position upon separation between said process unit and operative means of the main assembly.

31. A process unit according to claim 30, wherein the main assembly of the image forming apparatus includes an upper part and a lower part and said separation occurs between said process unit and said lower part.

32. A process unit according to claim 30, wherein said main assembly includes an upper part and a lower part, and said separation is caused by lowering the lower part of the process unit.

33. A process unit according to claim 30, wherein said separation is caused by drawing the process unit out of the main assembly.

34. A process unit according to claim 30, wherein said supporting means includes swingable arms.

35. A process unit according to claim 30, wherein the supporting means for said cover includes rails.

36. A process unit according to claim 30, further comprising dowels for moving when said process unit means is moved from said predetermined position.

37. A process unit according to claim 30, further comprising a pin for moving when said process unit means is moved from said predetermined position.

38. A process unit according to claim 30, wherein said protection cover protects said image bearing member from mechanical damage to said image bearing member.

39. A process unit according to claim 30, wherein said protection cover protects said image bearing member from stain.

40. A process unit according to claim 30, wherein said protection cover protects said image bearing member from receiving external light.

41. The image formation apparatus or the process unit according to claims 1, 19 and 30, wherein said cover is a protective cover for preventing the surface of said image bearing member from being injured.

42. The image formation apparatus or the process unit according to claims 1, 19 and 30, wherein said cover is a light-intercepting cover for intercepting light to the surface of said image bearing member.

* * * * *